US006872100B2

(12) United States Patent
Correll et al.

(10) Patent No.: US 6,872,100 B2
(45) Date of Patent: Mar. 29, 2005

(54) TERMINAL LOCKING MECHANISM FOR HYBRID ELECTRICAL CONNECTOR

(75) Inventors: Michael A. Correll, Middletown, PA (US); Daniel R. Ringler, Elizabethville, PA (US); Justin S. McClellan, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/460,900

(22) Filed: Jun. 13, 2003

(65) Prior Publication Data

US 2004/0253880 A1 Dec. 16, 2004

(51) Int. Cl.[7] ..... H01R 13/514
(52) U.S. Cl. ..... 439/752
(58) Field of Search ..... 439/752

(56) References Cited

U.S. PATENT DOCUMENTS

| | | | | |
|---|---|---|---|---|
| 3,766,513 A | | 10/1973 | Carre | 339/31 R |
| 4,544,220 A | | 10/1985 | Aiello et al. | 339/59 M |
| 4,750,893 A | | 6/1988 | Sueyoshi et al. | 439/596 |
| 4,867,705 A | | 9/1989 | Yuasa | 439/595 |
| 5,076,806 A | | 12/1991 | Hotea et al. | 439/595 |
| 5,203,722 A | | 4/1993 | Kinoshita | 439/595 |
| 5,378,176 A | * | 1/1995 | Sasai | 439/752 |
| 5,785,557 A | | 7/1998 | Davis | 439/660 |
| 6,012,954 A | * | 1/2000 | Wu | 439/752 |
| 6,699,079 B2 | * | 3/2004 | Machida et al. | 439/752 |

FOREIGN PATENT DOCUMENTS

| | | | |
|---|---|---|---|
| EP | 0 951 102 A2 | 10/1999 | H01R/23/68 |

* cited by examiner

*Primary Examiner*—Phuong Dinh

(57) ABSTRACT

A hybrid electrical connector includes both signal and power contacts in the same connector housing. The housing includes a plurality of axially extending passageways for receipt of the signal contacts and a plurality of axially extending cavities for receipt of the power contacts. The connector housing further includes a plurality of terminal retaining inserts for the signal contacts. These inserts are latchably retained to the housing, and have a closed face on one side and an open face on the other, with axially extending open slots. The inserts stack one against the other to lock the terminals in place.

23 Claims, 4 Drawing Sheets

TERMINAL LOCKING MECHANISM FOR HYBRID ELECTRICAL CONNECTOR

The subject invention relates to an improved electrical connector housing and more particularly to an improved secondary retention feature for the retention of electrical terminals within their housing.

BACKGROUND OF THE INVENTION

It is quite common in the electrical connector industry today to require that electrical terminals have redundant retention means within their connector housings. The first or primary means of retaining the electrical terminals within the housing is to have a stamped-out lance from the electrical terminal metal body, which abuts a shoulder within the housing. The redundant or secondary retention means is typically profiled as a plastic movable member, which can be moved into place over the terminal to lock the terminal in place. Some of these members are moved transversely of the axial direction, while some are defined as hinged flaps, which are rotated into place. These flaps include plastic tabs which, when rotated, reside in a groove or gap within the terminal to retain the contact in place.

In one prior method, as shown for example in U.S. Pat. No. 4,750,893, an electrical connector housing has a hinged flap, which rotates, into place. The electrical connector has an insulating housing and a plurality of electrical terminals disposed in terminal receiving passageways within the housing. The housing includes an upper retention flap including a retention tab which, when in its locked location, is positioned adjacent to an edge of the terminal to retain the terminal in the passageway. The flap has tabs which reside at an edge of the contact to prevent withdrawal thereof. If more than one row of contacts is present, then two hinged flaps on the outside of each of the two rows are used to retain the terminals in place.

It is also well known in the industry to provide a hybrid electrical connection system, comprised of both signal and power contacts. See, for example, U.S. Pat. No. 5,785,557 and EP Patent Application 0951102. In particular with hybrid connectors, given the complexity and cost, it is desirable to be able to remove and/or replace contacts within the connector without destroying or damaging the electrical connector or any of the connections thereto.

The objects of the invention are therefore to improve upon these known connection systems.

SUMMARY OF THE INVENTION

The objects of the invention have been accomplished by providing an electrical connector, comprising an insulative housing having a plurality of contact receiving cavities therethrough, defined in a matrix of columns and rows. The housing has a front mating face, a rear contact receiving face and an upper and lower extension wall extending from the rear contact receiving face. A plurality of electrical terminals are positioned in the cavities, and the terminals having a locking shoulder adjacent to the rear contact receiving face. A plurality of terminal locking members are positionable between the upper and lower extension walls, and are movable to a position where a front edge of the inserts are positioned adjacent to the rear wall, thereby retaining the terminals in the cavities.

Preferably, the terminal locking members have a closed surface on one side thereof, and have a plurality of open passageways on an open opposite surface thereof, whereby when the terminal locking members are stacked one against the other, closed passageways are defined for a wire connected to the terminals to pass therethrough. The closed passageways are axially extending and U-shaped in cross-section. The terminal locking members are defined for a column of terminal receiving cavities, with the axially extending passageways aligned vertically on the open surface.

The terminal locking members and the upper and lower extension walls are cooperatively profiled with alignment members to laterally align the terminal locking members with the corresponding column of terminal receiving cavities. The upper and lower extension walls are provided with grooves aligned with the columns of terminal receiving cavities, and the terminal locking members are provided with corresponding alignment ribs for receipt in the grooves.

A latching mechanism is cooperatively provided by the housing and terminal locking members to retain the terminal locking members in a fixed position. The latching mechanism is comprised of locking lugs positioned on an outside surface of the extension walls, and latching arms extending from the terminal locking members and profiled to be received over the upper and lower extension walls, in locking engagement with the locking lugs.

The terminals are comprised of a front contact section, an intermediate wire contacting section, a rearward wire strain relief section and an integral extension shoulder extending rearwardly defining the locking shoulder.

In another aspect of the invention, an electrical connector comprises an insulative housing having a plurality of contact receiving cavities therethrough, defined in a matrix of columns and rows. The housing has a front mating face, a rear contact receiving face and extension walls extending from the rear contact receiving face to form two parallel and opposed walls flanking the matrix. A plurality of electrical terminals are positioned in the cavities, the terminals having a locking shoulder adjacent to the rear contact receiving face. A plurality of terminal locking members are positionable between the extension walls, and are movable to a position where a front edge of the inserts are positioned adjacent to the rear wall, thereby retaining the terminals in the cavities. A latching mechanism is cooperatively provided by the housing and terminal locking members to retain the terminal locking members in a fixed position.

Preferably, the terminal locking members have a closed surface on one side thereof, and have a plurality of open passageways on an open opposite surface thereof, whereby when the terminal locking members are stacked one against the other, closed passageways are defined for a wire connected to the terminals to pass therethrough. The closed passageways are axially extending and U-shaped in cross-section. The extension walls are defined as upper and lower walls depending from the housing along respective upper and lower edges thereof. The terminal locking members are defined for a column of terminal receiving cavities, with the axially extending passageways aligned vertically on the open surface.

The terminal locking members and the upper and lower extension walls are cooperatively profiled with alignment members to laterally align the terminal locking members with the corresponding column of terminal receiving cavities. The upper and lower extension walls are provided with grooves aligned with the columns of terminal receiving cavities, and the terminal locking members are provided with corresponding alignment ribs for receipt in the grooves.

The latching mechanism is comprised of locking lugs positioned on an outside surface of the extension walls, and latching arms extending from the terminal locking members and profiled to be received over the upper and lower extension walls, in locking engagement with the locking lugs. The terminals are comprised of a front contact section, an intermediate wire contacting section, a rearward wire strain relief section and an integral extension shoulder extending rearwardly defining the locking shoulder.

In yet another embodiment, an electrical connector, comprises an insulative housing having a plurality of contact receiving cavities therethrough, defined in a matrix of columns and rows. The housing has a front mating face, a rear contact receiving face and extension walls extending from the rear contact receiving face to form two parallel and opposed walls flanking the matrix. A plurality of electrical terminals are positioned in the cavities, the terminals having a locking shoulder adjacent to the rear contact receiving face. A plurality of terminal locking members are positionable between the extension walls, and are movable to a position where a front edge of the inserts are positioned adjacent to the rear wall, thereby retaining the terminals in the cavities. Alignment members are provided by the terminal locking members and the extension walls, and are cooperatively profiled to align the terminal locking members with a linear array of terminal receiving cavities.

The terminal locking members have a closed surface on one side thereof, and have a plurality of open passageways on an open opposite surface thereof, whereby when the terminal locking members are stacked one against the other, closed passageways are defined for a wire connected to the terminals to pass therethrough. The closed passageways are axially extending and U-shaped in cross-section.

The extension walls are defined as upper and lower walls depending from the housing along respective upper and lower edges thereof. The terminal locking members are defined for a column of terminal receiving cavities, with the axially extending passageways aligned vertically on the open surface. The upper and lower extension walls are provided with grooves aligned with the columns of terminal receiving cavities, and the terminal locking members are provided with corresponding alignment ribs for receipt in the grooves.

The latching mechanism is cooperatively provided by the housing and terminal locking members to retain the terminal locking members in a fixed position. The latching mechanism is comprised of locking lugs positioned on an outside surface of the extension walls, and latching arms extending from the terminal locking members and profiled to be received over the upper and lower extension walls, in locking engagement with the locking lugs. The terminals are comprised of a front contact section, an intermediate wire contacting section, a rearward wire strain relief section and an integral extension shoulder extending rearwardly defining the locking shoulder.

The invention will now be described by way of reference to the drawings.

DETAILED DESCRIPTION OF THE PREFERRED EMBODIMENT

Figure 1:
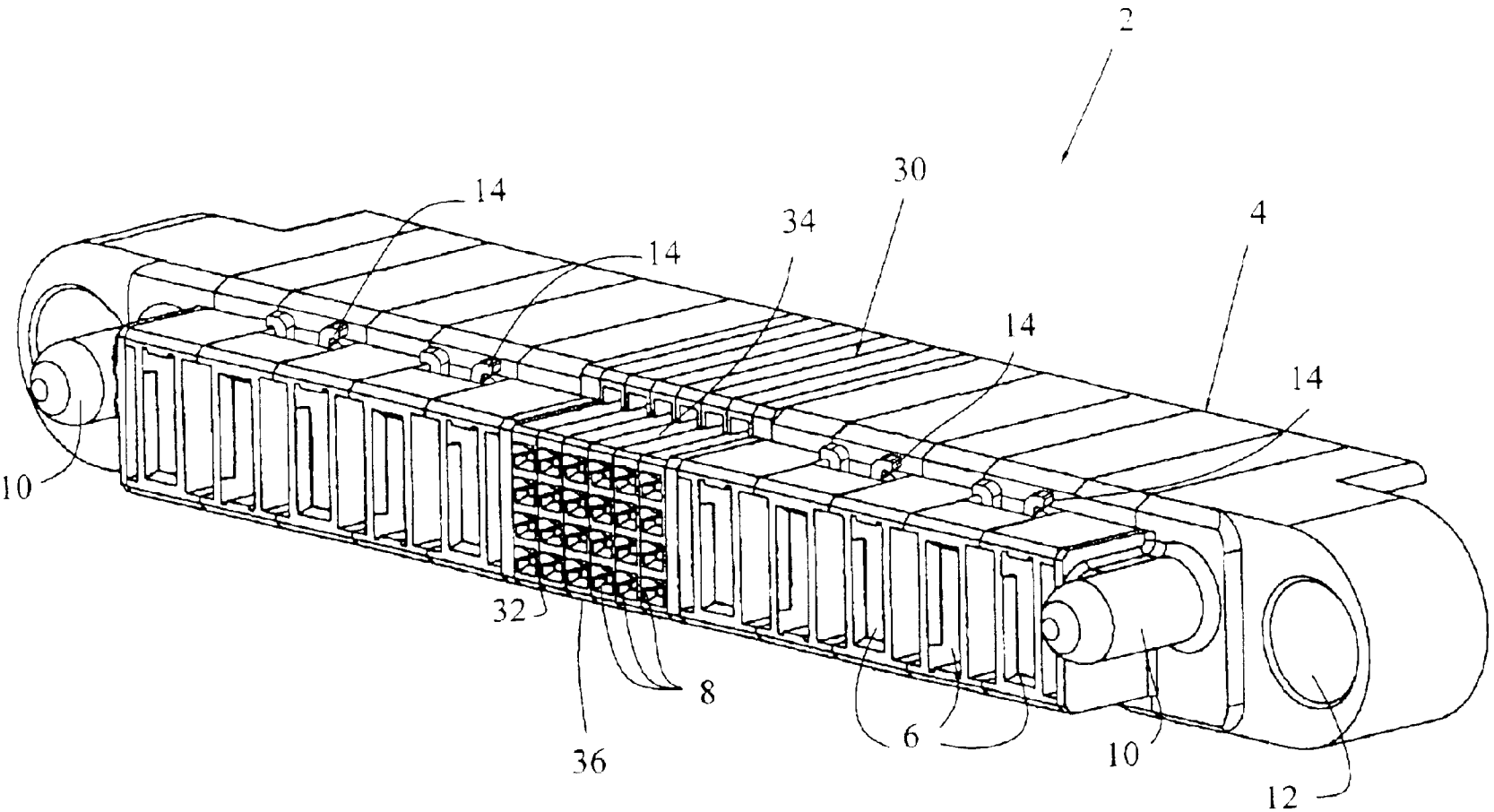
FIG. 1 is a perspective view showing the hybrid electrical connector of the present invention.
Figure 2:
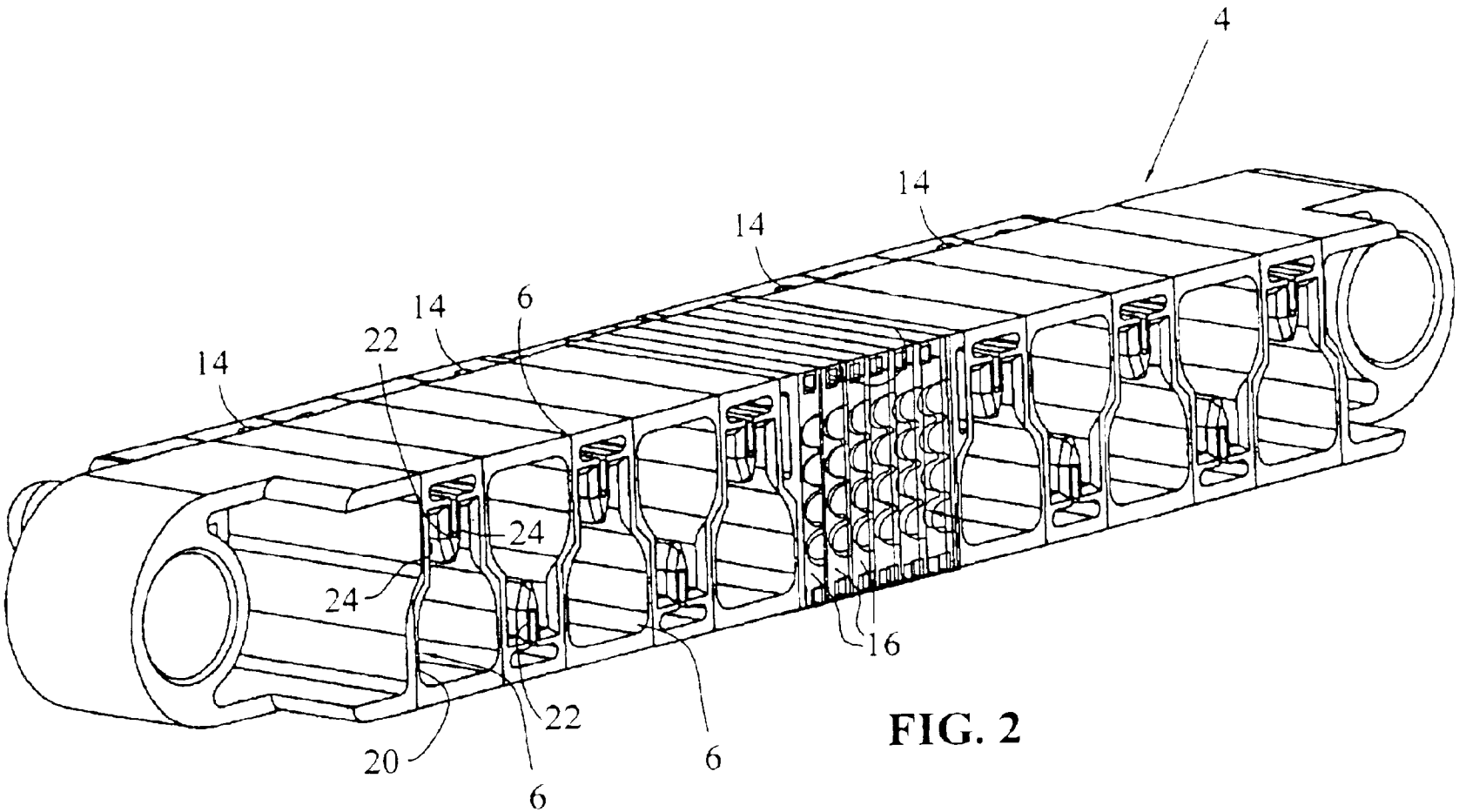
FIG. 2 is a rear perspective view of the connector of FIG. 1.

With reference first to FIG. 1, a connector is shown at 2 as a hybrid electrical connector, having a housing 4 with a plurality of contact cavities 6 for receipt of power contacts, and a plurality of contact receiving cavities 8 for receipt of signal contacts. The housing 4 further includes polarizing lugs at 10 and mounting apertures at 12, which are further described in co-pending patent application Ser. No. 10/460,884, filed on even date herewith, and incorporated herein by reference. With reference still to FIG. 1, the power terminal receiving cavities include terminal locking members 14 snapped in place to retain the terminals in the individual passageways 6, as will be described further herein. As shown in FIG. 2, a rear perspective view of the connector housing 4 is shown, where the power terminal receiving cavities 6 are shown in greater detail. Each of the cavities 6 includes an enlarged opening portion 20 and an oppositely positioned rib portion 22 witch is flanked by two slot portions 24. Finally, the connector housing 4 includes a plurality of locking inserts 16 to lock the signal contacts in place.

Figure 3:
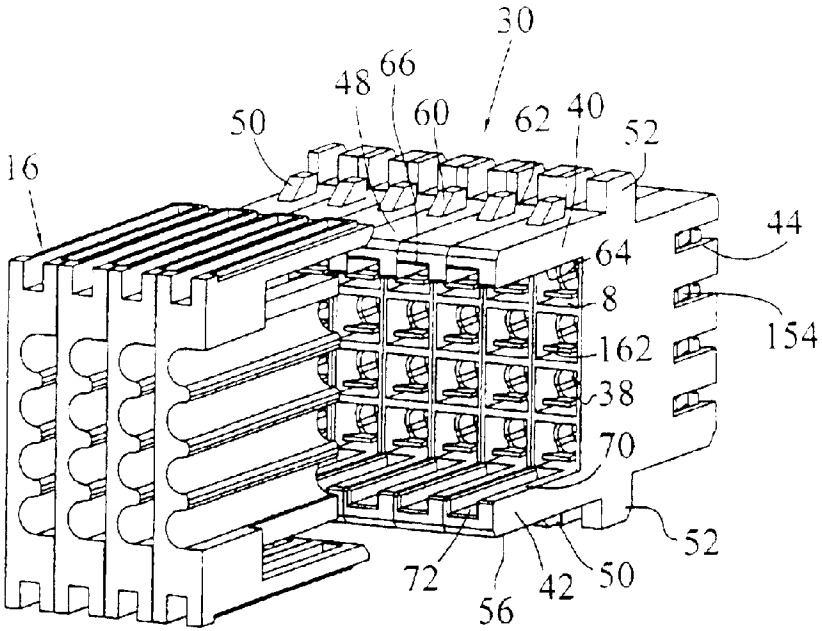
FIG. 3 is a fragmentary perspective view showing the terminal locking member of the signal terminal cavities poised for receipt in its perspective slot.

With reference to FIGS. 1 and 3, the detail of the housing 4 and the contact receiving cavities 8 will be described in greater detail. As shown in FIG. 1, housing 4 includes in the central section thereof, a matrix of the cavities 8, which are arranged in a plurality of rows and columns. The central section of the housing 2, which is designated for the signal contacts, will be referred to generally at 30 and includes a front mating face 32, with upper and lower surfaces at 34 and 36, respectively. With reference now to FIG. 3, housing portion 30 further includes a rear contact receiving face at 38, which is flanked by upper 40 and lower 42 extension walls.

Each of the contact cavities extends from the rear face 38 to the front mating face 32. As shown in FIG. 3, contact receiving cavities 8 are generally rectangular in cross-section and include an open slot 44 adjacent the front mating face for locking contacts therein, as will be described in further detail herein. As shown in FIG. 3, the extension wall 40 includes an upper surface at 48, having locking lugs at 50, with protection stand-offs at 52. Meanwhile, extension wall 42 has an outer surface at 56, having a second set of locking lugs 50, and a second set of protection stand-offs 52. Each of the locking lugs 50 includes an inclined ramp surface at 60 and a rear locking surface at 62.

Extension wall 40 further comprises an inner surface at 64, which includes a plurality of alignment grooves at 66, where one alignment groove is provided for each column of the terminal receiving cavities 8. As also shown in FIG. 3, lower wall 42 further includes an inner surface at 70, having guide channels 72, which are generally aligned with upper guide channels 66 and which are generally aligned with one alignment guide per column of terminal receiving cavities 8.

With respect to FIGS. 3, 4, and 5, the terminal locking inserts 16 will be described in greater detail. With respect first to FIG. 5, one aide of the terminal locking inserts 16 includes a central locking portion at 80, having an upper latch 82 and lower latch 84 extending from the central section 80 and extending forwardly therefrom. The central section 80 includes a closed face at 86 on one side thereof (FIG. 5) and an open side at 88, which includes a plurality of axially extending open slots or channels 90. These channels 90 are generally U-shaped in cross-section and extend between a front edge 92 and a rear edge 94.

The central section 80 further includes a top edge 100 and a bottom edge 102, thereby defining gaps 104, 106 between the edges and their respective latch member. As shown in FIG. 4, the top edges 100, 102 are defined as guide ribs having surfaces 110, 112 and 114, 116. It should be appreciated that the width of the ribs formed by surfaces 110, 112 and 114, 116 are appropriately chosen so as to be slidably receivable in associated slots 66, 72. With respect still to FIG. 4, the terminal retaining inserts 16 further include intermediate portions 120 and 122, which interconnect the central portion 80 with the latches 82, 84. The intermediate portions 120 and 122 have planar surfaces 124 and 126, which extend across the entirety of the intermediate sections 120, 122 and extend along an edge of the respective latches 82, 84. This is to accommodate abutment of individual side-by-side terminal retaining inserts 16, as will be described herein.

Figure 5:
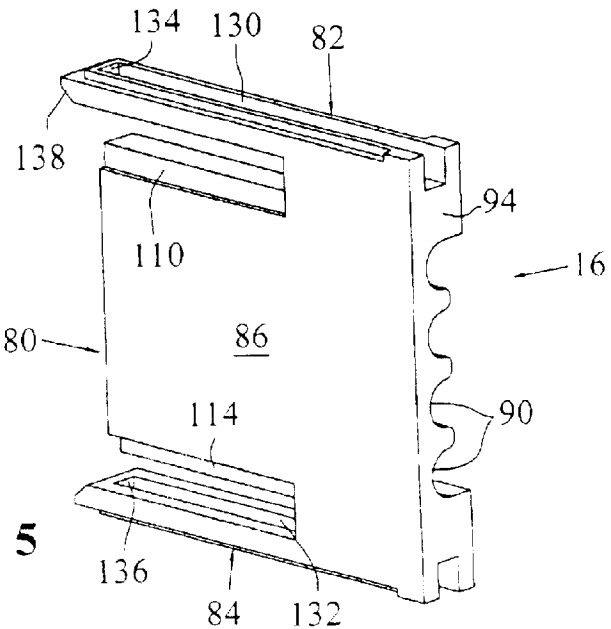
FIGS. 4 and 5 show perspective views of the signal terminal locking mechanism from different perspectives.
Figure 4:
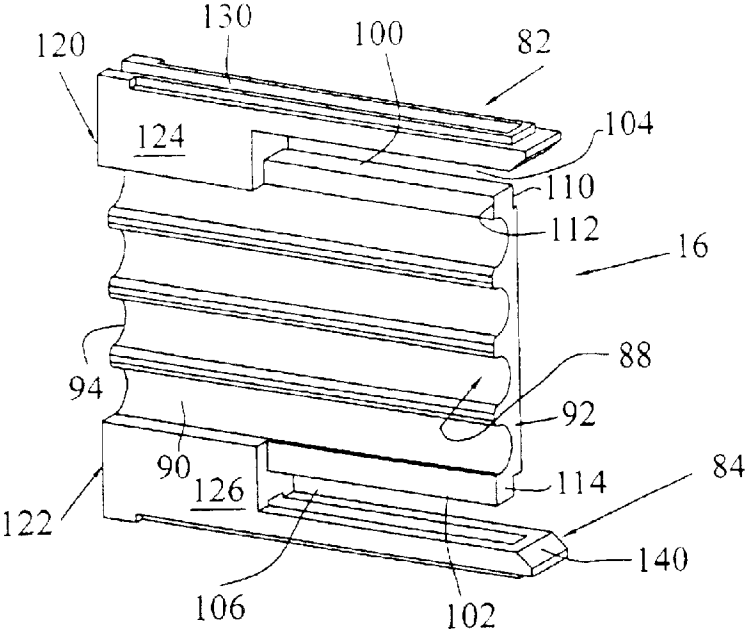

As shown in both FIGS. 4 and 5, latches 82 are cantilevered forward from the intermediate portions 120 and 122 with gaps 104 and 106 extending between the cantilevered portion. Each of the latches 82, 84 includes slots 130, 132, which extends from the rear face 94 of the inserts and extends forwardly to a position forward of front edge 92 to thereby define locking edges 134, 136, respectively. Each latch 92 includes a beveled ramp portion at 138, 140, as will be described.

With respect now to FIG. 7, a signal contact 150 for receipt for one of the contact cavities will be described herein. It should be realized, however, that the contact per se is not a subject of the invention and that virtually any type of signal contact could be used in the embodiment described. However, for illustrative purposes and for purposes of describing the invention, a representative contact 150 would normally include a front contact section 152 having a locking lance 154 and some type of contact portion at 156. This contact portion 156 could be individual contact arms or could be stamped-out dimples or other projections, which extend inwardly for contact with a mating pin. The contact 150 would further include a crimped section 158, which would be crimped around a stripped wire, as is well known in the connector art. Rearward of the crimped section is a strain relief member 160, which is crimped around the wire, but around the insulation to strain relieve the wire crimp connection at 158. Rearward of the strain relief section 160 is a shoulder section 162 extending from the base of the contact, which forms a locking edge, as will be described further herein. As shown in FIG. 3, regardless of the contact geometry, the terminal would be profiled such that edge 162 would lie adjacent to contact receiving face 38.

With the individual components as described above, the operation of the hybrid connector 2 will now be described in greater detail. With respect to FIG. 3, the signal housing section 30 would be loaded by having a plurality of contacts 150 positioned in cavities 80, such that locking lances 154 are locked within associated slots 44 of housing 4. With the contacts fully positioned as mentioned above, and as shown in FIG. 3, individual terminal retaining inserts 16 may now be positioned into a locked configuration, where the inserts 16 are latched to housing 4 and where terminals are secondarily locked within housing 4.

It should be appreciated that the terminals 150 could be loaded in either of two ways. First, the contacts could be loaded from the left to the right as viewed in FIG. 3, where a single column of terminals are loaded at a time. Alternatively, all of the contacts could be loaded prior to installing any of the terminal retaining inserts. However, it should be appreciated from the above that, when the terminals are loaded within their respective cavities 8, individual insulated wires extend outwardly from the crimped section at 158. Thus, to insert the contact retaining inserts, four of the wires of a column are positioned within respective passageways formed by the channels 90, and the insert is slidably guided by the ribs 110 and 114 that are aligned with the grooves 66 and 72.

Figure 6:
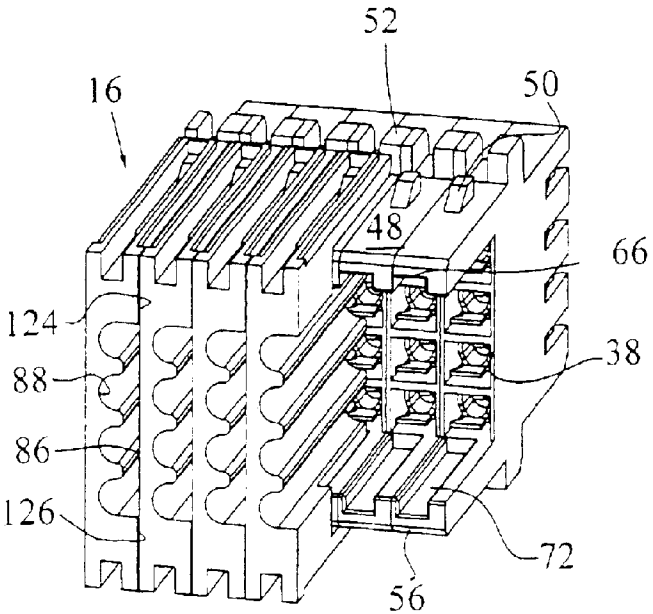
FIG. 6 is a view similar to that of FIG. 3, showing the terminal locking member in full position.

Further movement of the inserts 16 towards the housing causes latches 82, 84 to meet the individual locking lugs 50, such that the ramped surfaces 138, 140 engage the corresponding ramps 60 on the locking lugs 50. This causes the latch arms 82, 84 to ride up over the ramp, such that locking surfaces 134 and 136 engage behind rear surface 62 of the locking lugs 50. This positions the front portion of the latch arms 82, 84 between locking lugs 50 and the protection stand-offs 52, as shown in FIG. 6. As such, individual terminal retaining inserts 16 can be stacked one against the other with planar surfaces 124 and 126 of a first retaining insert butted up against the closed face 86 of the adjacent insert 16. As such, the adjacent inserts 16 close off the open side of the channels 90, such that the individual wires are held in place and extend through the insert 16.

Figure 7:
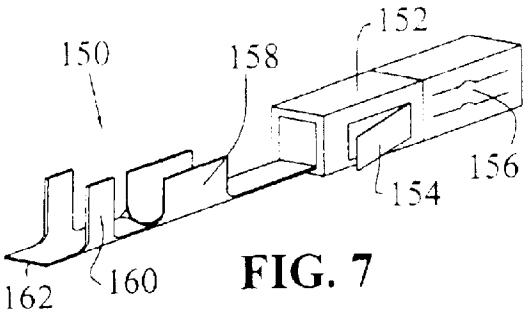
FIG. 7 shows a perspective view of a representative signal contact for receipt within the cavities.

At the same time, front edge 92 of the central section 80 of inserts 16 is positioned in an abutting manner with the terminal receiving face 38 with the edge 92 adjacent to shoulders 162 of terminal 150 (FIG. 7). This provides a secondary lock of the terminals within their corresponding passageways.

Advantageously, in the event that a signal contact or more than one contact is damaged and needs replacement, the terminal retaining inserts 16 can be individually removed, thereby providing access to a column of the terminals 150, such that individual terminals can be removed and thereafter replaced.

What is claimed is:

1. An electrical connector, comprising:

an insulative housing having a plurality of contact receiving cavities arranged in a matrix of columns and rows, said housing having a front mating face, a rear contact receiving face and upper and lower extension walls extending from said rear contact receiving face;

a plurality of electrical terminals positioned in said cavities, each of said terminals having a locking shoulder adjacent to said rear contact receiving face; and a plurality of terminal locking inserts positionable between said upper and lower extension walls, and being movable to a position where a front edge of said inserts is positioned adjacent to said rear contact receiving face, thereby retaining said terminals in said cavities, each of said terminal locking inserts having a closed surface on one side thereof, and a plurality of open channels on an opposite side thereof, whereby when said terminal locking inserts are stacked one against the other, closed passageways are defined through said inserts for wires connected to said terminals to extend therethrough.

2. The electrical connector of claim 1, wherein said closed passageways are axially extending and U-shaped in cross section.

3. The electrical connector of claim 1, wherein each said terminal locking insert is aligned with a respective said column of contact receiving cavities.

4. The electrical connector of claim 1, wherein said terminal locking inserts and said upper and lower extension walls are cooperatively profiled with alignment members to laterally align said terminal locking inserts with respective said columns of contact receiving cavities.

5. The electrical connector of claim 4, wherein said upper and lower extension walls are provided with grooves aligned with said columns of contact receiving cavities, and said terminal locking inserts are provided with corresponding alignment ribs for receipt in said grooves.

6. The electrical connector of claim 1, further comprising a latching mechanism cooperatively provided by said housing and said terminal locking inserts to retain said terminal locking inserts in a fixed position.

7. The electrical connector of claim 6, wherein said latching mechanism is comprised of locking lugs positioned on outside surfaces of said upper and lower extension walls, and latching arms extending from said terminal locking inserts are profiled to be received over said upper and lower extension walls, in locking engagement with said locking lugs.

8. The electrical connector of claim 1, wherein each of said terminals includes a front contact section, an intermediate wire contacting section, a rearward wire strain relief section and an integral extension shoulder extending rearwardly defining said locking shoulder.

9. An electrical connector, comprising:

an insulative housing having a plurality of contact receiving cavities arranged in a matrix of columns and rows, said housing having a front mating face, a rear contact receiving face and extension walls extending from said rear contact receiving face to form two parallel and opposed walls flanking said matrix;

a plurality of electrical terminals positioned in said cavities, each of said terminals having a locking shoulder adjacent to said rear contact receiving face;

a plurality of terminal locking inserts positionable between said extension walls, said extension walls having grooves aligned with said columns of contact receiving cavities, and said terminal locking inserts having corresponding alignment ribs for receipt in said grooves, wherein said terminal locking inserts are guided for movement to a position where a front edge of said inserts is positioned adjacent to said rear contact receiving face, thereby retaining said terminals in said cavities; and a latching mechanism cooperatively provided by said housing and said terminal locking inserts to retain said terminal locking inserts in said position.

10. The electrical connector of claim 9, wherein each of said terminal locking inserts has a closed surface on one side thereof, and a plurality of open channels on an opposite side thereof, whereby when said terminal locking inserts are stacked one against the other, closed passageways are defined through said inserts for wires connected to said terminals to pass therethrough.

11. The electrical connector of claim 10, wherein said closed passageways are axially extending and U-shaped in cross-section.

12. The electrical connector of claim 10, wherein said extension walls are defined as upper and lower walls depending from said housing along respective upper and lower edges thereof.

13. The electrical connector of claim 12, wherein each said terminal locking insert is aligned with a respective said column of contact receiving cavities.

14. The electrical connector of claim 9, wherein said latching mechanism is comprised of locking lugs positioned on outside surfaces of said extension walls, and latching arms extending from said terminal locking inserts are profiled to be received over said extension walls, in locking engagement with said locking lugs.

15. The electrical connector of claim 9, wherein each of said terminals includes a front contact section, an intermediate wire contacting section, a rearward wire strain relief section and an integral extension shoulder extending rearwardly defining said locking shoulder.

16. An electrical connector, comprising:

an insulative housing having a plurality of contact receiving cavities arranged in a matrix of columns and rows, said housing having a front mating face, a rear contact receiving face and extension walls extending from said rear contact receiving face to form two parallel and opposed walls flanking said matrix;

a plurality of electrical terminals positioned in said cavities, said terminals having a locking shoulder adjacent to said rear contact receiving face;

a plurality of terminal locking inserts positionable between said extension walls, said extension walls, having grooves aligned with said columns of contact receiving cavities, and said terminal locking inserts having corresponding alignment ribs for receipt in said grooves wherein said terminal locking inserts are guided for movement to a position where a front edge of said inserts is positioned adjacent to said rear contact receiving face, thereby retaining said terminals in said cavities.

17. The electrical connector of claim 16, wherein each of said terminal locking inserts has a closed surface on one side thereof, and a plurality of open channels on an opposite side thereof, whereby when said terminal locking inserts are stacked one against the other, closed passageways are defined through said inserts for wires connected to said terminals to pass therethrough.

18. The electrical connector of claim 17, wherein said closed passageways are axially extending and U-shaped in cross-section.

19. The electrical connector of claim 17, wherein said extension walls are defined as upper and lower walls depending from said housing along respective upper and lower edges thereof.

20. The electrical connector of claim 19, wherein each said terminal locking insert is aligned with a respective said column of contact receiving cavities.

21. The electrical connector of claim 16, further comprising a latching mechanism cooperatively provided by said housing and said terminal locking inserts to retain said terminal locking inserts in said position.

22. The electrical connector of claim 21, wherein said latching mechanism is comprised of locking lugs positioned on outside surfaces of said extension walls, and latching arms extending from said terminal locking inserts are profiled to be received over said extension walls, in locking engagement with said locking lugs.

23. The electrical connector of claim 16, wherein each of said terminals includes a front contact section, an intermediate wire contacting section, a rearward wire strain relief section and an integral extension shoulder extending rearwardly defining said locking shoulder.

* * * * *